United States Patent [19]

Curry

[11] 3,981,043

[45] Sept. 21, 1976

[54] SLIDABLE TOOL GRIP

[76] Inventor: Christian O. Curry, 8 Block Island Drive, Sound Beach, N.Y. 11789

[22] Filed: Jan. 14, 1975

[21] Appl. No.: 541,000

[52] U.S. Cl. ..... 16/110 R; 15/147 D; 16/114 R; 81/52.3; 172/371; 294/57

[51] Int. Cl.[2] ..... B25G 1/00

[58] Field of Search ..... 74/551.8, 551.9; 294/57, 58, 59, 54; 15/147 D; 81/52.3, 52.35, 177 R, 61 C, 61 D, 61 G; 273/75; 16/110 R, 114 R, 108, 109; 37/53; 172/371

[56] References Cited

UNITED STATES PATENTS

| | | | |
|---|---|---|---|
| 271,303 | 1/1883 | Blaker | 294/57 |
| 1,224,724 | 5/1917 | Dyer | 15/147 D |
| 1,993,336 | 3/1935 | Brell | 15/147 D |
| 3,751,094 | 8/1973 | Bohler | 294/58 |

FOREIGN PATENTS OR APPLICATIONS

| | | | |
|---|---|---|---|
| 896,742 | 5/1962 | United Kingdom | 294/58 |

*Primary Examiner*—Werner H. Schroeder
*Assistant Examiner*—Conrad L. Berman
*Attorney, Agent, or Firm*—Stephen E. Feldman

[57] ABSTRACT

A hand grip is slidably disposed on the handle of a tool, of the type normally requiring the use of two hands such as an ax, broom or shovel, for grasping by one of the hands of the user, and for movement between a stop disposed proximate the free end of the handle and a stop, if required, disposed proximate the tool end of the handle. The hand grip is relatively rigid in directions generally parallel to the length of the tool handle; but can be compressible in directions perpendicular to the length of the tool handle to facilitate a non-slidable grasping of the tool handle when required. End pieces compressible in directions parallel to the length of the tool handle may be fitted to each end of the hand grip to absorb shocks which might otherwise be encountered at the extremities of travel of the hand grip.

9 Claims, 7 Drawing Figures

FIG. 1
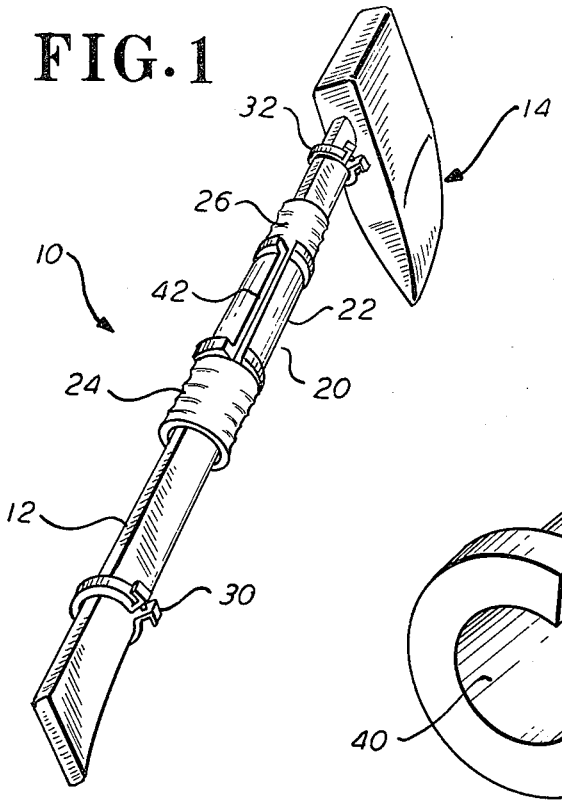
FIG. 2
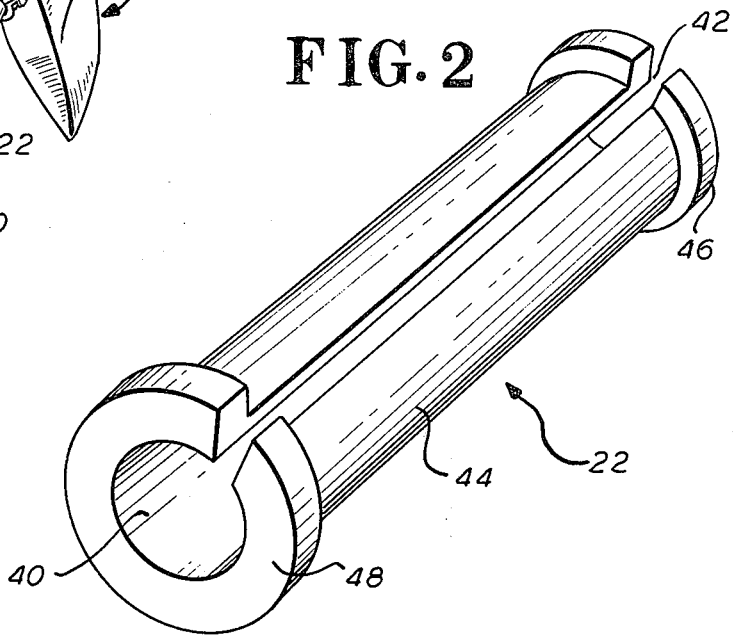
FIG. 3
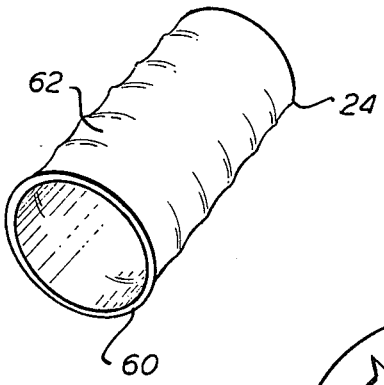
FIG. 4
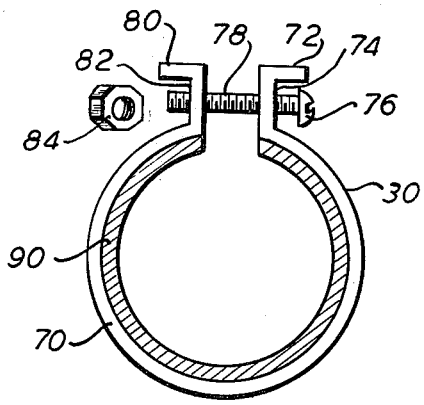
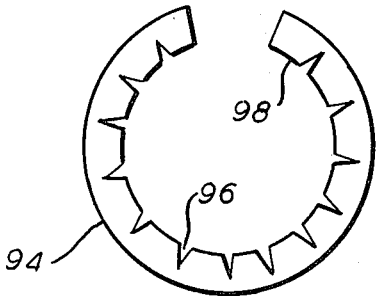
FIG. 5

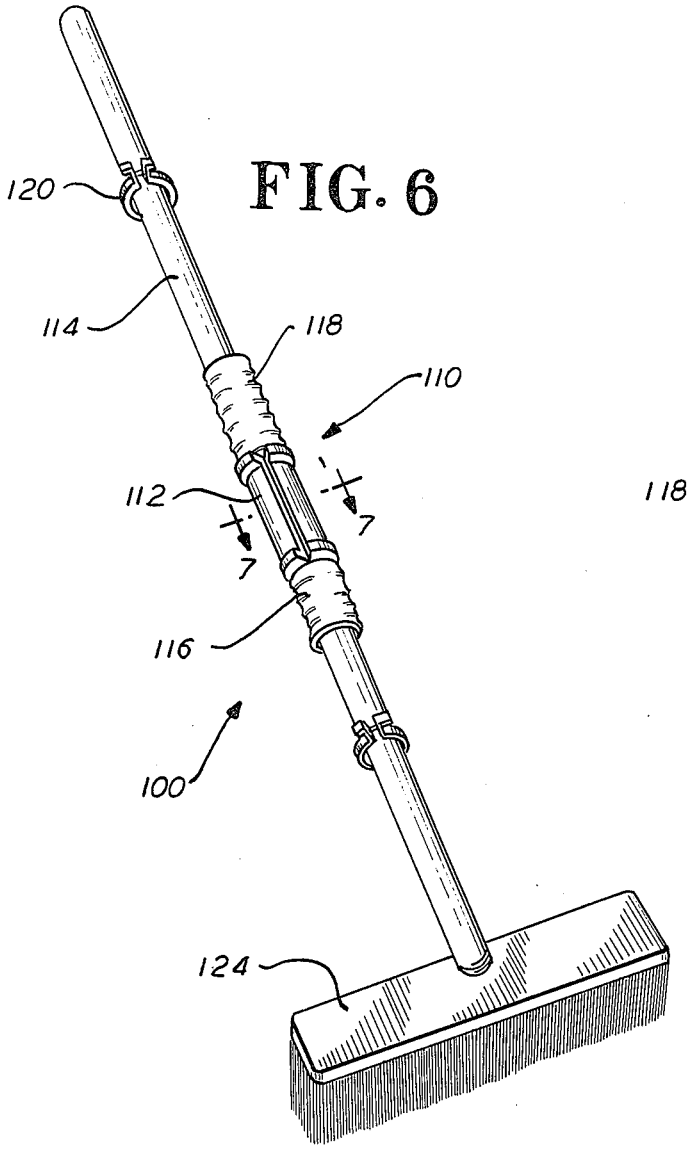
FIG. 6
FIG. 7
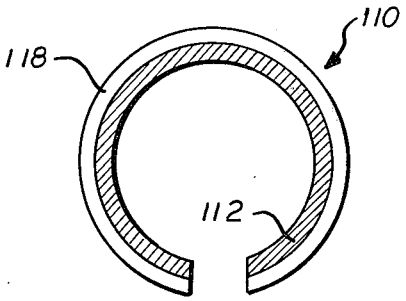

SLIDABLE TOOL GRIP

BACKGROUND OF THE INVENTION-FIELD OF APPLICATION

This invention relates to hand grips for the handles of tools, and more particularly to a slidable hand grip for one hand of the user of a tool with a handle normally requiring two hand use.

BACKGROUND OF THE INVENTION-PRIOR ART

A great many tools are fitted with handles adapted for grasping by both hands of the user. Amongst these are tools which may be referred to as striking tools such as sledge hammers, picks, axes and the like; push and pull tools such as brooms, rakes, hoes, and the like; and lifting and tossing tools such as shovels, pitch forks, and the like.

When initially grasping these two hand tools one hand of the user usually grasps the free end of the handle; that is the handle end furthest from the tool. The other hand of the user grasps the handle at a location intermediate the free end and the tool end. Quite often such other hand grasps the tool handle at a location very close to the tool itself.

As the tool is used the hand at the free end of the handle usually stays at that location while the other hand, disposed nearer the tool, may either remain in that position or may be required to slide along the handle during proper use of the tool. In using a broom or rake for example, one either may firmly grasp the handle at two positions and use the broom with both hands remaining where initially positioned, especially when pushing or pulling heavy materials. However, if the materials are relatively light the user may keep one hand in place while sliding the handle with respect to the intermediately positioned hand to achieve a longer stroke with less body movement. When using an ax or sledge hammer the hand positioned proximate the tool end of the handle must move along the handle for proper use of the tool.

Presently movement of the user's hand along the tool handle results in many detrimental side effects. As the handle gets older, or affected by the weather, the moving hand may easily pick up a splinter from a wooden tool handle, or rust and dirt from a metal tool handle. The rubbing action of the moving hand on the tool handle quite often results in developing a blister. To combat this the user may wear gloves but in warm weather one's hand will sweat in gloves and this further adds to difficulty in using the tool.

One of the worst side effects is the friction that is produced during the relative movement of the hand and tool handle. This friction not only has detrimental effects on the user's hand but it also slows down the tool movement. As such, power being imparted by the user to the tool is dissipated, especially in striking tools, and tool use efficiency is diminished.

Some efforts have been made to modify tool handles but to date these have usually involved modifying the handle to better accommodate the hand which does not move, as shown by U.S. Pat. No. 418,479 granted to C. A. Davis on Oct. 8, 1889; or adding something to the handle to minimize the transmission to the user of shock developed during tool use as shown in U.S. Pat. No. 1,800,254 granted to F. J. Holmes on Apr. 14, 1931 and U.S. Pat. No. 271,929 granted to H. F. Seybert on Feb. 6, 1883. In fact in the Seybert patent the disposition of the shock absorbing spring on the pick handle must surely restrict the movement of the hand which must move and that has to diminish the impact forces required for proper action of the pick.

Where a slide has been used on a prior art device, such as that shown in U.S. Pat. No. 1,873,294 granted on Aug. 23, 1932 to J. T. Cosgrove and U.S. Pat. No. 2,622,781 granted on Dec. 23, 1952 to M. O. Polson, their use has generally been restricted to impact action pulling tools of the type used by mechanics.

SUMMARY OF THE INVENTION

It is therefore an object of this invention to provide a new and improved hand grip for a tool.

It is another object of this invention to provide a new and improved hand grip for the handle of a tool wherein the user of the tool normally grasps the handle with both hands.

It is still another object of this invention to provide a new and improved hand grip adapted to permit one hand of the user to either firmly grasp the handle of a tool or to slide along the handle of a tool wherein the tool handle requires grasping by both hands of the user.

It is yet still another object of this invention to provide a new and improved hand grip adapted for sliding movement between stopping means disposed proximate both ends of a tool hanndle and for grasping by one hand of the user of a tool requiring two hands for its proper use.

It is a further object of this invention to provide a new and improved hand grip for slidable disposition on the handle of a tool wherein the user normally grasps the handle with one hand proximate the free end of the handle and with the other hand disposed intermediate the free end and the tool end through the use of said slidable hand grip.

In carrying out the invention, according to the preferred embodiment thereof, a pair of stops are provided on the handle of a tool of the type requiring two hands use; one stop disposed near the free end of the tool handle and the other stop proximate the tool end of the handle. Disposed between the stops is a gand grip sized to receive one hand of the user and so as to substantially circle the tool handle; and formed from material permitting relatively frictionless bi-directional sliding along the tool handle. The hand grip may be compressible in directions perpendicular to the length of the tool handle to permit non-sliding grasping of the handle when desired and may also be provided with end pieces compressible in directions parallel to the length of the tool handle to absorb shocks resulting from impact of the hand grip with the stops.

Other objects, features, and advantages of the invention in its details of construction and arrangement of parts will be seen from the above, from the following description of the preferred embodiment when considered in conjunction with the drawings and from the appended claims.

BRIEF DESCRIPTION OF THE DRAWINGS

In the drawings:

FIG. 1 is a perspective view of a striking tool in the form of an ax provided with stops and a slidable hand grip incorporating the instant invention;

FIG. 2 is a perspective view of the central section of the slidable hand grip of FIG. 1;

FIG. 3 is a perspective view of one of the end pieces adapted to be fitted onto the slidable hand grip of FIGS. 1 and 2;

FIG. 4 is an elevational view of one of the stops of FIG. 1;

FIG. 5 is an elevational view of an alternate form for the central section of the hand grip of FIG. 1 serrated along the length thereof to facilitate compressibility in the radial direction;

FIG. 6 is a perspective view of a push pull tool in the form of a broom provided with stops and a slidable hand grip of modified form but incorporating the instant invention; and FIG. 7 is a sectional view along line 7—7 of FIG. 6.

DESCRIPTION OF THE PREFERRED EMBODIMENT

For convenience, the invention will be described as applied to a striking tool in the form of an ax and to a push-pull tool in the form of a broom, each having thereon a removable stop disposed near the free end of the handle and a removable stop disposed near the tool end of the handle, and each having slidably disposed between the stops a hand grip with a central section that is relatively rigid in directions parallel to the length of the handle while being compressible in directions perpendicular to the length of the handle, and which carries at its extremities, end pieces which are compressible in directions parallel to the length of the handle; it being understood nevertheless: that without departing from the scope of this invention, that the subject hand grip may be applied to other striking tools such as sledge hammers, picks, and the like, to other push-pull tools such as rakes and hoes, and the like, and even lifting and tossing tools such as shovels, pitch forks and the like; that the stop disposed near the tool end of the handle may be replaced by the configuration of the handle; that both stops may be built into and from the material of the tool handle; and that the hand grip need not carry compressible end pieces but may itself be adapted to engage the stops.

With reference to FIG. 1, there is generally shown at 10 a striking tool in the form of an ax having a handle 12 and an ax head 14 both of generally conventional configuration. A hand grip 20 (FIG. 1), having a central section 22 (FIGS. 1 and 2) spanned by end pieces 24 (FIGS. 1 and 3) and 26, is disposed about handle 12 for sliding movement between a first stop 30 (FIGS. 1 and 4) and a second stop 32 (FIG. 1).

Central section 22 of hand grip 20 is formed from suitable plastic or rubber material with a relatively smooth inner surface 40 so as to minimize the friction reaction with handle 12. It is arranged in a substantially "C" shape by being formed with a slot 42 extending its entire length. Central section 22 may, if desired, be formed from a tubular member which is cut to the proper length and then provided with slot 42. Suitable metals may also be formed to proper shape and used for central section 22.

An intermediate gripping portion 44, sized and adapted to receive the user's hand, is formed on central section 22 of hand grip 20 between flared ends 46, 48. Flared ends 46, 48 may coact directly with stops 30 and 32, during sliding action of hand grip 20 to protect the user's hand from striking same. Alternatively flared ends 46, 48 may receive end pieces 24 and 26.

Central section 22 is formed to be relatively rigid in the direction parallel to the length of handle 12 but due to slot 42 to yield somewhat in directions perpendicular to the length of handle 12. End pieces 24 and 26, on the other hand, are perferably formed from wire 60 wound in spring like fashion and covered with suitable cloth or rubber material 62 similar to conventional vacuum cleaner hose. In fact end pieces 24, 26 may be made from sections of vacuum cleaner hose. As such, end pieces 24, 26 are relatively incompressible in directions perpendicular to the length of handle 12 but will yield in compression to absorb the shock of hand grip 20 striking a stop 30 or 32.

End pieces 24, 26 will also minimize rotation of hand grip 20 around handle 12 so that once positioned therein slot 42 thereof will always be properly positioned. In addition, all the elements of hand grip 20 are sized to readily slide along handle 12 and may also expand slightly as they encounter enlarged portions of handle 12. This action slows down hand grip 20 prior to striking of stops 30 or 32.

Stops 30 (FIGS. 1 and 4) and 32 are identically constructed and include an outer split ring member 70 (FIG. 4) having an upturned ear 72 recessed at 74 to accomodate a head 76 of a threaded member 78 of conventional construction and which passes through a suitable aperture formed on ear 72 (not shown). A second upturned ear 80 is formed on split ring 70 with a suitably disposed aperture (not shown) to receive the other end of threaded member 78. A recess 82 is formed in ear 80 to receive a hex nut 84 which is threaded onto member 78 to tighten same about handle 12.

If desired a layer of material 90 may be suitably secured to the inner surface of ring 70. Material 90 may either be rubber or cloth and should be chosen so as to assist stops 30 and 32 to better accomodate the configuration of handle 12 and to firmly remain positioned thereon even when being struck by hand grip 20.

The user may prefer to use only one stop 30 and to eliminate stop 32 and instead have the tool itself determine the travel of hand grip 20 in that direction. Alternatively suitable stops may be formed from the material of handle 12 integral therewith. Such formation of the stops could be accomplished with the initial manufacture of handle 12.

It is important to note that stop 30 must be positioned inwardly from the free end (the end opposite the tool) of handle 12 a distance sufficient to allow comfortable grasping of said free end by the user.

An alternative construction for intermediate gripping portion 44 of hand grip 20 is shown at 94 in FIG. 5. Longitudinally disposed slits 96 are formed in inner surface 98 thereof to facilitate compression of intermediate portion 94 in the radial direction to facilitate gripping of the tool handle where such is desired as in use of a broom.

In using hand grip 20 the user first secures stop 32 (which is identical in construction to stop 30) proximate tool 14 by firmly tightening threaded member 78 into hex nut 84. Hand grip 20 is then disposed about handle 12. Stop 30 is positioned inwardly of the free end of handle 12 a distance sufficient to accomodate the hand of the user and secured in position by tightening threaded member 78 into hex nut 84.

The user grasps the free end of handle 12 with one hand and hand grip 20 with the other. The user's palm should be about intermediate gripping portion 44 between flared ends 46, 48. As the user uses tool 10 the hand at the free end of handle 12 remains in position while the hand on hand grip 20 freely slides along handle 12 between stops 30, 32.

This action provides for a smoother operation of tool 10, greater impact forces due to reduced friction effects and minimizes detrimental side effects (blisters, sweating, etc.) on the user's hands.

Hand grip 20 may also be used, in a manner similar to that described above, for other striking tools such as sledge hammers and picks, for lifting and tossing tools such as shovels and pitch forks, and for push and pull tools such as rakes, hoes, and brooms. For such uses a stop, like stops 30 and 32, is secured proximate the free end of the tool handle; remembering to leave hand holding room between the stop and said free end of the tool handle. A second stop may be disposed near the tool end of the handle if so desired. Hand grip 20 is, of course slidably disposed between the stops or between the single stop and the tool.

In some instances, it is necessary to be able to either slide the one hand along the tool handle or to be able to grip the tool handle at a selected location with that hand. This is especially required for push and pull tools like a broom such as that shown at 100 in FIG. 6. If hand grip 20 is used it would be most advantageous to utilize the internal construction for gripping a portion thereof such as shown in FIG. 5. This construction permits compression of said intermediate portion in a radial direction to facilitate grasping of the tool handle.

Alternatively a hand grip 110 (FIGS. 6 and 7) may be utilized. Hand grip 110 includes an intermediate portion 112 formed from suitable plastic, rubber or like material and with a relatively thin cross section to permit compression thereof in the radial direction, facilitates gripping of broom handle 114 at one selected location. End pieces 116, 118, carried by intermediate portion 112, are formed of the same or similar materials but with a relatively larger cross section and act to absorb shocks which might otherwise be transmitted to the user.

A stop 120, which may be similar to stops 30 and 32, is secured near the free end of broom handle 114. The broom 124 itself serves as the other stop for hand grip 110.

In pushing or pulling a heavy load, the user of broom 100 would probably need to grip handle 114 at two selected places in order to properly operate on the load. The selected places are chosen to accommodate the user. When the load is relatively light, the user would exert less pressure upon hand grip 20 permitting a sliding action thereof along handle 114. As such, the user need not bend over as far in using broom 100.

From the above description, it will thus be seen that a novel and improved slidable hand grip has been provided for the handle of a tool normally requiring two hands use; which hand grip is relatively inexpensive and simple in construction and use and may either facilitate an easy and relatively friction free sliding action for one hand of the user along the tool handle or alternatively an easy and selective grasping of the tool handle.

It is understood that although I have shown the preferred forms of my invention that various modifications may be made in the details therein without departing from the spirit as comprehended by the following claims:

I claim:

1. In combination with a tool, a gripping arrangement for use with said tool having a handle which is normally gripped by both hands of the user, said combination comprising:

a tool;

a handle connected to said tool;

gripping means formed for slidable disposition on the handle of the tool and for movement therealong between positions proximate tool end of said handle and the free end of the said handle opposite the tool end thereof;

said gripping means being of a size and configuration to accommodate one hand of the user of the tool;

at least one stop means detachably attached near the free end of the handle at a position therein, leaving room between itself and the free end of the handle to permit grasping of the handle proximate the free end by the other hand of the user; and end means carried by said gripping means at the extremities thereof to protect the hand of the user from striking said stop means and the tool disposed at the tool end of the handle, said end means including means relatively incompressible in a direction perpendicular to the length of the handle but relatively compressible in a direction parallel to the length of the handle so as to absorb end shocks developed by said gripping means approaching the extremities of its travel.

2. The combination of claim 1 wherein a second stop means is disposed proximate the tool end of the handle.

3. The combination of claim 1 wherein said stop means substantially surrounds the handle.

4. The combination of claim 1 wherein said stop means encircles the handle and is provided, on the surface thereof adjacent the handle, with yieldable means formed to accommodate the configuration of the handle.

5. The combination of claim 1 wherein said gripping means is flared at its ends to provide said end means.

6. The combination of claim 1 wherein said gripping means substantially encircles the handle and carries as said end means at each extremity thereof substantially tubular means relatively incompressible in directions perpendicular to the length of the handle but relatively compressible in a direction parallel to the length of the handle so as to absorb shocks developed by said gripping means approaching the extremity of its travel in either direction.

7. The combination of claim 6 wherein said end means are formed from generally spiral wound spring wire covered by a layer of material.

8. The combination of claim 1 wherein said gripping means is serrated upon its inner surface disposed proximate the outer surface of the handle and in directions parallel to the length of the handle to facilitate relative compression of said gripping in directions perpendicular to the length of the handle when disposed therewithin.

9. The combination of claim 1 wherein said end means and said gripping means are formed to substantially encircle the tool handle and wherein said end means are further formed with a radial thickness which is greater in dimension then the radial thickness of said gripping means and in such a manner as to permit compression of said gripping means in a radial direction.

* * * * *